US005538243A

United States Patent [19]

Yamamoto et al.

[11] Patent Number: 5,538,243

[45] Date of Patent: Jul. 23, 1996

[54] TENNIS RACKET FRAME

[75] Inventors: Ken Yamamoto, Akashi; Teruo Nakamura, Yokohama, both of Japan

[73] Assignee: Sumitomo Rubber Industries, Ltd., Hyogo-Ken, Japan

[21] Appl. No.: 209,245

[22] Filed: Mar. 14, 1994

[30] Foreign Application Priority Data

Mar. 16, 1993 [JP] Japan ..... 5-055675

[51] Int. Cl.[6] ..... A63B 49/14

[52] U.S. Cl. ..... 273/73 D; 273/73 R; 273/73 C

[58] Field of Search ..... 273/73 C, 73 G, 273/73 R, 73 D, 73 H, 730, DIG. 1

[56] References Cited

U.S. PATENT DOCUMENTS 3,647,211 3/1972 Doessel et al. ..... 273/73 C 5,009,422 4/1991 Soong ..... 273/73 D 5,102,132 4/1992 Chen ..... 273/73 d

*Primary Examiner*—Vincent Millin

*Assistant Examiner*—Charles W. Anderson

*Attorney, Agent, or Firm*—Birch, Stewart, Kolasch & Birch, LLP

[57] ABSTRACT

A tennis racket frame comprising a string-installing portion (10), T-shaped in cross section, formed along the entire periphery of a ball-hitting surface thereof. The string-installing portion (10) comprises a projection (20) formed toward the ball-hitting surface in which strings are installed and a base (21) perpendicular to the projection (20). A plurality of gut holes (25) are formed on the projection (20) such that each of the gut holes (25) penetrates through the center thereof. A plurality of gut holes (24) is formed on the bottom surface of a concave (23) of the base (21) such that each of the gut holes (24) penetrates through the center of the base (21).

3 Claims, 12 Drawing Sheets

Fig. 4A PRIOR ART
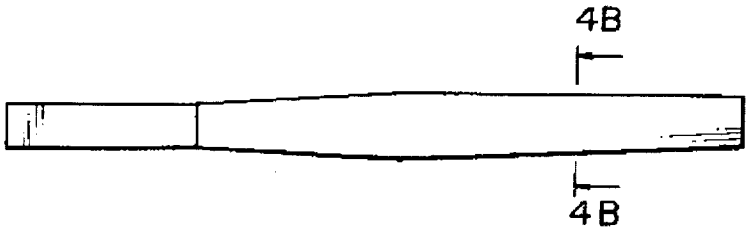
Fig. 4B
PRIOR ART
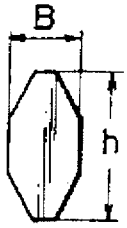
Fig. 5A PRIOR ART
(I)
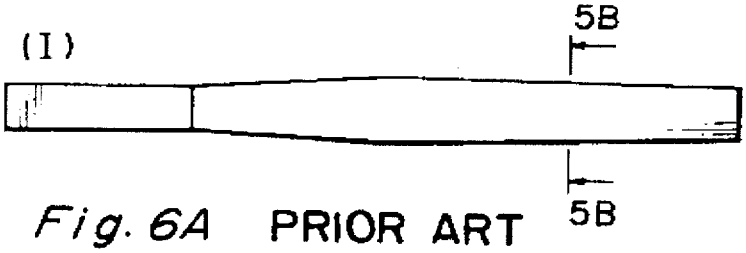
Fig. 5B
PRIOR ART
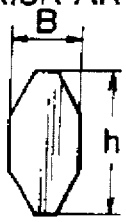
Fig. 6A PRIOR ART
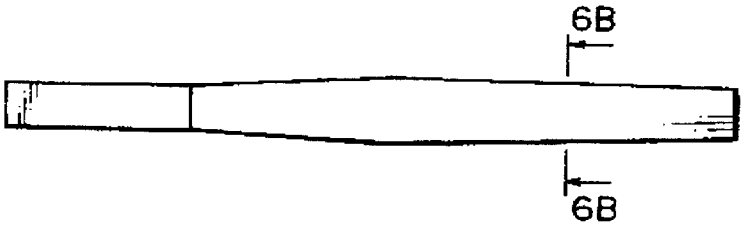
Fig. 6B PRIOR ART
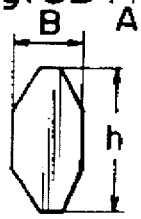
Fig. 7A PRIOR ART
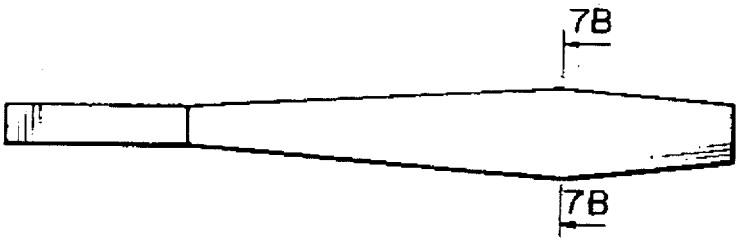
Fig. 7B
PRIOR ART
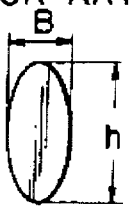
Fig. 8A PRIOR ART
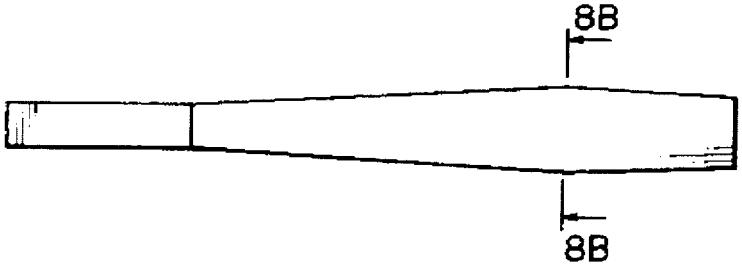
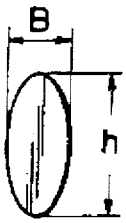
Fig. 8B
PRIOR ART Fig. 16A
CONVENTIONAL
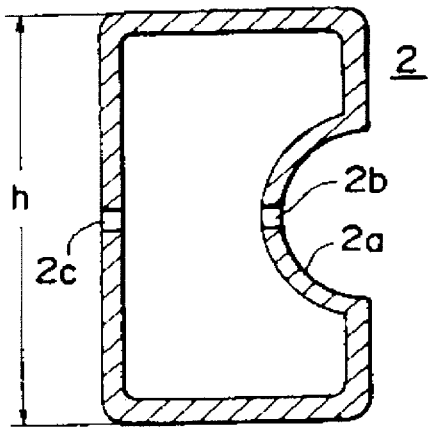
Fig. 16B
CONVENTIONAL
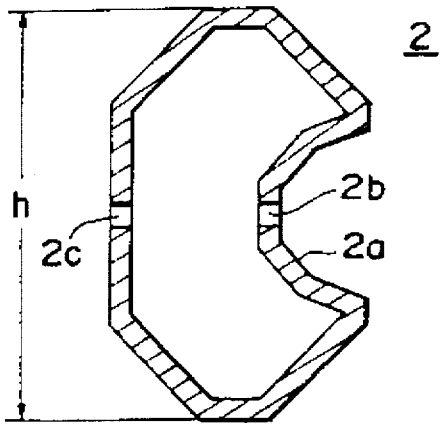
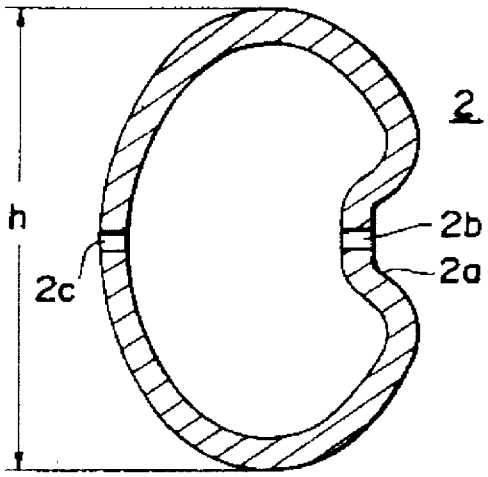
Fig. 16C
CONVENTIONAL

TENNIS RACKET FRAME

BACKGROUND OF THE INVENTION

1. Field of the Invention

The present invention relates to a tennis racket frame and more particularly, to a tennis racket having a favorable repulsion performance and ball control performance and giving a soft ball-hitting feeling to a player by improving the cross sectional configuration of a string-installing portion of the frame thereof.

2. Description of the Related Art

Research has been made to improve the performance of the tennis racket and as a result, tennis rackets in various configurations have been proposed. The configurations of the tennis rackets developed recently are classified into the following three types:

1. Mid (standard) size racket;
2. Rackets having a large ball-hitting surface, namely, the so-called large racket; and
3. Rackets having a large vertical sectional area of a string-installing section of the racket frame, namely the so-called thick racket.

A tennis racket is required to have a favorable repulsion performance and ball control performance and provide a soft ball-hitting feeling to a player. The main factor for determining these performances is the spring characteristics.

The spring characteristics are classified into the following four types as shown in FIGS. 15A, 15B, and 15C in consideration of the construction of the racket.

(1) Spring shown by (A) of FIG. 15 generated by the deformation of strings 1[.];

(2) Spring shown by (B) of FIG. 15 generated by the deformation of a supporting portion (string-installing portion) 2 for supporting the strings 1;

(3) Spring shown by (C) of FIG. 15 generated by the in-plane deformation of a racket frame 3; and (4) Spring shown by (D) of FIG. 15 generated by the out-of-plane deformation of the racket frame 3.

It is considered that the above four springs are connected in series with each other and hence a most deformable spring determines the characteristic of the racket.

Observing the deformation of the mid (standard) size racket which occurs when a tennis ball collides with the ball-hitting surface thereof, the racket frame 3 is deformed like a spoon as shown in FIG. 15C. The spring (D) generated by the out-of-plane deformation of the racket frame 3 is the main factor for determining the characteristic of the racket.

Because the ball-hitting area of the mid size racket is smaller than that of the large racket, the in-plane rigidity of the former is higher than that of the latter and thus, the stability of ball-hitting surface of the former is more favorable than that of the latter and hence, ball control performance of the former is higher than that of the latter.

Because the thickness (h) of the string-installing portion 2 is smaller than that of the thick racket, the out-of-plane rigidity of the former is low and thus, the mid size racket is flexible and gives a soft feeling to the player in hitting a tennis ball.

As described above, the mid size racket has a favorable ball control performance and gives a soft feeling to the player in hitting the tennis ball, but the spring main factor for determining the characteristic thereof is generated due to the spring (D) caused by the out-of-plane deformation of the racket frame 3. The spring (D) does not greatly contribute to the improvement of the repulsion performance of the racket. The large racket and the thick racket have been developed to improve the repulsion performance of the racket.

In the large racket having a large ball-hitting area, the spring (A) generated by the deformation of the strings 1 is the main factor for determining the characteristic thereof and thus the large racket has a favorable repulsion performance.

In the thick racket in which the thickness (h) of the string-installing portion 2 is great, the main factors for determining the characteristic thereof are the spring (A) generated by the deformation of the strings 1 and the spring (B) generated by the deformation of string-installing portion 2. In particular, curved peripheral surfaces of the string-installing portion 2 are deformed and thus a strong spring generated due to the return of the deformation of the curved peripheral surfaces displays a higher repulsion performance than the large racket.

The string-installing portion 2 of the conventional tennis racket frame has an approximately rectangular, sectional configuration as shown in FIG. 16A; an approximately, octagonal sectional configuration as shown in FIG. 16B; or an approximately elliptical, sectional configuration as shown in FIG. 16C. The frame has, on the center of the outer side of the string-installing portion 2, a concave portion 2*a* into which a grommet used to install a string thereon is inserted; and has gut holes 2*b* and 2*c* on the center of the bottom surface of the concave portion 2*a* and the inner side of the string-installing portion 2 opposed to the center of the bottom surface of the concave portion 2*a*, respectively.

The thickness (h) of the mid size racket and that of the thick racket are approximately 20 mm and 30 mm at the largest portion thereof, respectively.

The ball-hitting area of the mid size racket and that of the large racket are approximately 93 to 95 square inches and 105 to 108 square inches, respectively.

As described above, the large racket and the thick racket have a higher repulsion performance than the mid size racket, respectively, whereas they have a lower ball control performance than the mid size racket and give a less soft ball-hitting feeling to the player than the mid size racket for the reason which is described below.

That is, because the large racket has a larger ball-hitting area than the mid size racket, the in-plane rigidity of the ball-hitting surface of the large racket is lower than that of the mid size racket and thus the deformation amount of the in-plane deformation of the former is greater than that of the latter. Thus, the stability degree of the ball-hitting surface of the large racket is inferior and thus the ball control performance thereof is unfavorable.

In the thick racket, the deformation of the spring (B) generated by the deformation of the string-installing portion 2 is restored in a shorter time period than the other springs (A), (C) and (D). Thus, the period of time in which the thick racket and the ball are in contact with each other is short and thus the ball control performance thereof is unfavorable.

In addition, because the thickness (h) of the thick racket is great, the thick racket does not generate the out-of-plane deformation, thus giving a hard ball-hitting feeling to the player when the player hits the ball with the thick racket. Impacts generated in ball hitting are transmitted to the arm of the player. Hence, when the player continues to use the thick racket for a long time, the player may develop a tennis elbow on the arm or the elbow.

SUMMARY OF THE INVENTION

It is accordingly an object of the present invention to provide a tennis racket which is superior in repulsion performance and ball control performance and gives a soft ball-hitting feeling to a player.

In accomplishing these and other objects of the present invention, there is provided a tennis racket comprising a string-installing portion which is T-shaped in cross section, formed along the entire periphery of a ball-hitting surface thereof, wherein the string-installing portion comprises a projection formed toward the ball-hitting surface in which strings are installed and a base perpendicular to the projection.

The string-installing portion is hollow and has a plurality of gut holes formed on the projection such that each of the gut holes penetrates through the center thereof and a plurality of gut holes formed on the bottom surface of a concave portion of the base such that each of the gut holes penetrates through the center of the base.

The projection and the base are symmetrical with respect to a center line passing through the center of the projection. The gut holes are formed along the center line passing through the center of the projection.

It is possible to deviate the projection and the base from each other. It is also possible to incline the gut holes with respect to the center line passing through the center of the projection.

A fiber reinforced resin is molded into the racket frame.

Preferably, each corner of the string-installing portion is rounded.

It is preferable to set the width b1 of the projection and the thickness h1 of the projection as follows:

3 mm$\leqq$b1$\leqq$0.7B, 3 mm$\leqq$h1$\leqq$0.75h where B is the sum of the width of the base and the width b1 of the projection, and h is the thickness of the base.

According to the above construction, because the string-installing portion of the tennis racket frame is T-shaped in cross section, torsion deformation is generated on the string-installing portion when a ball is hit by the racket. The restoring force of the deformation imparts a spring, which cannot be provided by the conventional tennis racket, to the tennis racket according to the present invention. Different from the conventional springs adopted in the conventional large or thick racket, which acts by the sacrifice of other springs, the string-installing portion of the present invention displays its force in harmony with the four springs described previously. That is, the novel spring has the following characteristic:

(1) When the string-installing portion, which is T-shaped in cross section, is adopted in a mid size racket, the mid size racket provides repulsion performance as favorably as the thick racket in addition to the advantage of the mid size racket, namely, a favorable ball control performance and a soft feeling given to a player when the player hits a tennis ball.

(2) When the string-installing portion, which is T-shaped in cross section, is adopted in the large racket, the large racket improves the stability of the ball-hitting surface thereof and provides a favorable ball control performance and a soft feeling to the player when the player hits the ball in addition to a favorable repulsion performance.

(3) When the string-installing portion, which is T-shaped in cross section, is adopted in the thick racket, the racket provides a favorable ball control performance and increases the period of time in which the racket is in contact with the ball and increases ball control performance, thus giving a soft ball-hitting feeling to the player.

The reason why the repulsion performance can be improved by the T-shaped string-supporting portion in cross section is as follows:

That is, the repulsion performance depends on the magnitude of the returning force of the deformation of the racket when the ball is hit and the time period in which the ball-hitting surface and the ball are in contact with each other. That is, the magnitude of the impulse which is the product of the force and the time period determines the magnitude of energy to be applied to the ball.

Curves shown by three solid lines of FIG. 17 represent the relationship between force and the elapse of time between the time when a ball becomes in contact with the racket and the time when the ball loses contact with the racket in a conventional mid size racket (I), a large racket (II) and a thin racket (III).

Referring to FIG. 17, reference symbols $T_1$, $T_2$, and $T_3$ denote contact time periods, and $F_1$, $F_2$, and $F_3$ denote the maximum spring forces. The areas of portions surrounded with diagonal lines are respective impulses. If the areas, namely, impulses are equal to each other, the repulsion performances are equal to each other.

Accordingly, the repulsion performance can be increased by increasing spring force and the time period of contact between the ball and the strings.

The novel spring brought about by the torsion generated by the T-shaped string-installing portion in cross section enhances the spring force due to the effect of accelerating the return of the strings and in addition, allows the time period in which the ball and strings are in contact with each other to be long because the novel spring generates the action of encircling the ball due to the deformation of the projection caused by torsion.

Due to these effects, in the mid size racket, the contact period of time $T_1'$ can be set to be long and a maximum spring force $F_1'$ can be set to be large as shown by the chain line (I') of FIG. 18, and the product, namely, the impulse of the contact period of time $T_1'$ and the maximum spring force $F_1'$ can be changed to be large. Thus, it is possible to increase the repulsion performance with the advantageous features of the mid-size racket being maintained.

It is important that the tennis racket frame does not exceed a given weight.

The in-plane rigidity is apt to decrease in the large racket due to its large ball-hitting surface. If the sectional rigidity is increased by increasing the weight of the large racket, the weight thereof exceeds the above given weight.

In the thick racket, it is necessary to reduce the width of the string-installing portion in cross section so that the weight of the racket frame does not exceed the given weight. That is, the peripheral length of the string installing portion in cross section has a limitation because it is disadvantageous to make its weight greater than the given weight. Therefore, if the thickness of the string-installing portion is set to be large, supposing that the material of the racket frame is not altered and the thickness of a wall of the string-installing portion is not altered, it is necessary to set the width thereof to be shorter in correspondence with the increased amount of the thickness. Therefore, in the case of the thick racket, the width of the string-installing portion becomes smaller in correspondence with the increased amount of thickness and thus the in-plane rigidity is reduced similarly to the large racket.

On the contrary, because the string-installing portion, according to the present invention, is T-shaped in cross section and the projection is disposed on the inner side of the string-installing portion, the in-plane rigidity can be increased without exceeding the given weight.

That is, the rigidity of the string-installing portion in cross section is evaluated by a second moment of area (moment of inertia of area). For example, supposing that the thickness of a rectangle shown in FIG. 19 is h and the width thereof is b, the second moment of area is expressed as follows:

$$Ix=b\times h^3/12,\ Iy=b^3\times h/12$$

In the above equation, Ix (second moment of area for X) is a coefficient for determining the out-of-plane rigidity of the racket, and Iy (second moment of area for Y) is a coefficient for determining the in-plane rigidity thereof.

As indicated by the above equations, the second moment of area is proportional to the cube of the distance between the rotary axis of a sectional area and a periphery of the sectional area.

Accordingly, if the thickness (h) is set to be large without changing the peripheral length of the rectangle in cross section, the width (b) decreases and thus the in-plane rigidity decreases in proportion to the cube of the width (b). If the width (b) is set to be large to increase the out-of-plane rigidity, the thickness (h) decreases and thus the out-of-plane rigidity is reduced in proportion to the cube of the thickness (h). For example, if the thickness (h) is set to be twofold and the width (b) is set to be one-half, Ix which indicates the index of the out-of-plane rigidity becomes fourfold, whereas Iy which indicates the index of the in-plane rigidity becomes ¼ and thus Iy/Ix is 1/16.

Because the string-installing portion is T-shaped in cross section, the in-plane rigidity can be increased by arbitrarily selecting the correlation between the thickness of the string-installing portion and the width thereof without greatly reducing the out-of-plane rigidity.

More specifically, the string-installing portion is T-shaped and a state is generated in which the projection 20 mounted on the inner surface of the base 21 serves as a hoop. Due to the formation of the hoop, deformation toward the inside of the string-installing portion can be effectively restrained and thus, the effect of the hoop, which cannot be provided by the conventional racket frame, can be generated.

As described above, the in-plane rigidity can be designed freely, i.e., the repulsion performance can be enhanced by increasing the ball-hitting area without decreasing the in-plane rigidity. Accordingly, for example, a large racket having a superior repulsion performance and a favorable stability of the ball-hitting surface can be manufactured.

The out-of-plane rigidity of the thick racket becomes large due to its large thickness and hence, a player has a hard ball-hitting feeling and the time period in which the ball and the ball-hitting surface are in contact with each other is short. Even though designing is made to generate the out-of-plane deformation (flexibility) to some extent by reducing flexural rigidity, on the condition that the thickness of the string-installing portion is not reduced, the sectional width of a rectangle or that of an ellipse is substantially reduced in the conventional thick racket frame. Thus, it is difficult to maintain the in-plane rigidity.

On the above point, the T-shaped string-installing portion of the present invention restrains the in-plane deformation due to the above-described hoop effect. Thus, it is possible to design a thick racket which is flexible, gives a soft ball-hitting feeling, and allows the thick racket to maintain contact with the ball for a long period of time.

In addition, the T-shaped configuration of the string-installing portion prevents the vibration of the strings from being smoothly transmitted from the gut holes to the entire racket frame and thus the resonance of the racket frame with the vibration of the racket strings is avoided. The reason for this is described in detail later. Consequently, the vibration of the strings is restrained and the player has a favorable ball-hitting feeling.

BRIEF DESCRIPTION OF THE DRAWINGS

These and other objects and features of the present invention will become clear from the following description taken in conjunction with the preferred embodiments thereof with reference to the accompanying drawings, in which:

FIG. 4A is a front view showing a first comparison racket;

FIG. 4B is a sectional view, showing the first comparison racket, taken along a line 4B—4B of FIG. 4A;

FIG. 5A is a front view showing a second comparison racket;

FIG. 5B is a sectional view, showing the second comparison racket, taken along a line 5B—5B of FIG. 5A;

FIG. 6A is a front view showing a third comparison racket;

FIG. 6B is a sectional view, showing the third comparison racket, taken along a line 6B—6B of FIG. 6A;

FIG. 7A is a front view showing a fourth comparison racket;

FIG. 7B is a sectional view, showing the fourth comparison racket, taken along a line 7B—7B of FIG. 7A;

FIG. 8A is a front view showing a fifth comparison racket;

FIG. 8B is a sectional view, showing the fifth comparison racket, taken along a line 8B—8B of FIG. 8A;

FIG. 16A, 16B, and 16C are sectional views showing a string-installing portion of a conventional tennis racket;

DETAILED DESCRIPTION OF THE INVENTION

Figure 1A:
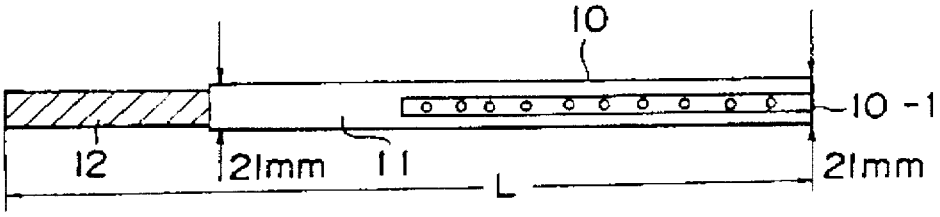
FIG. 1A is a front view showing a tennis racket according to a first embodiment of the present invention.
Figure 1B:
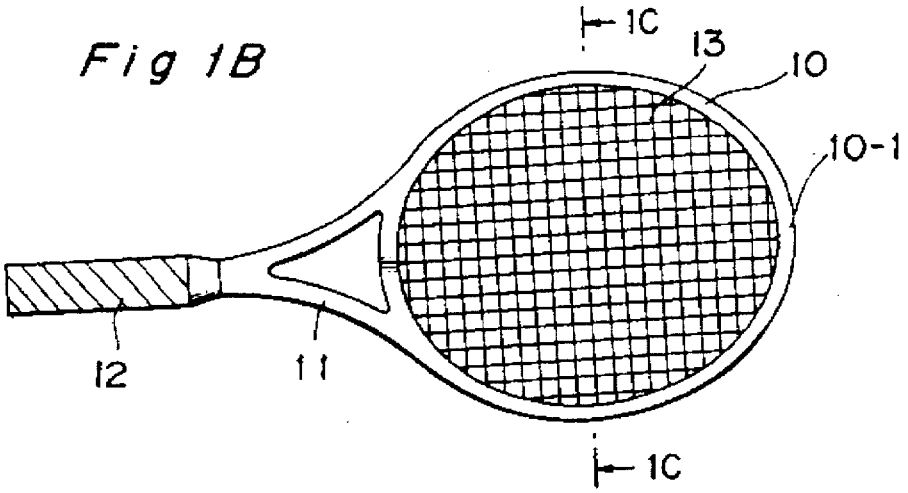
FIG. 1B is a plan view showing the tennis racket according to the first embodiment of the present invention.

Before the description of the present invention proceeds, it is to be noted that like parts are designated by like reference numerals throughout the accompanying drawings.

A tennis racket according to a first embodiment of the present invention is described below with reference to FIG. 1.

FIGS. 1A, 1B, 1C and 1D show a tennis racket frame according to the first embodiment of the present invention. The tennis racket frame comprises a string-installing portion 10, a throat portion 11, and a grip section 12.

Figure 1C:
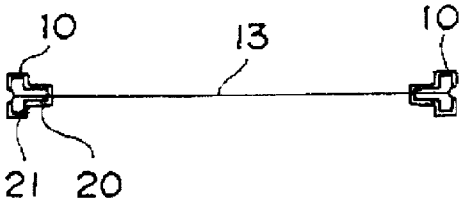
FIG. 1C is a sectional view, showing the tennis racket according to the first embodiment of the present invention, taken long a line III—III of FIG. 1B.
Figure 1D:
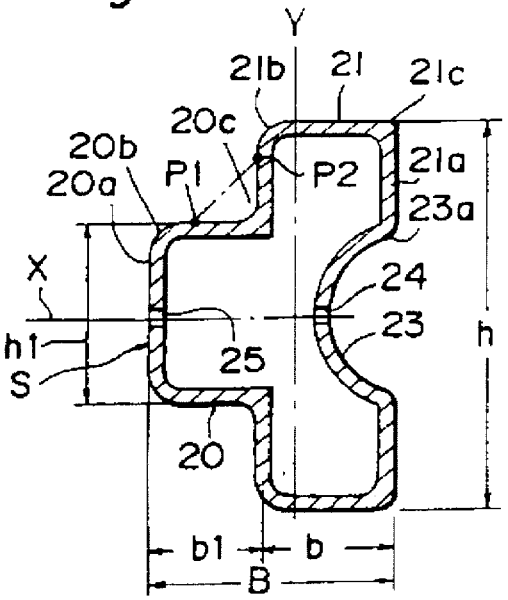
FIG. 1D is a sectional view, showing a string-installing portion, of the tennis racket according to a first embodiment of the present invention.

As shown in FIGS. 1C and 1D, the string-installing portion 10 hollow and sectionally T-shaped has a projection 20 formed on a ball-hitting side (S) on which strings 13 are mounted.

The string-installing portion 10 is T-shaped in cross section and comprises the projection 20 and a base 21 which are symmetrical with respect to a center line (X) passing through the center of the projection 20. A concave portion 23 into which a grommet is to be inserted is formed in the center of a peripheral surface 21*a* of the base 21. A plurality of outer gut holes 24 spaced at regular intervals is formed at the center, of the concave 23, through which the center line (X) passes. A plurality of inner gut holes 25 spaced at regular intervals is formed at the center, of an inner surface 20*a* of the projection 20, through which the center line (X) passes. Therefore, the outer gut hole 24 and the inner gut hole 25 are disposed on the center line (X).

Each corner of the string-installing portion 10, namely, corners 21*b* and 21*c* of the base 21; corners 20*b* of the projection 20; and corners 23*a* of the concave 23 is rounded at a desired curvature, respectively.

The curvature formed at the corner 20*c* at which the projection 20 and the base 21 are continuous with each other has a positive curvature disposed inside a line (shown by one-dot chain line) connecting a point P1 and a point P2 with each other. The point P1 is b1/4 distant from the corner 20*b*. The point P2 is (h−h1)/8 distant from the corner 21*b*. The reference symbols (b1) and (h1) denote the width and thickness of the projection 20 and (h) is the thickness of the base 21.

It is preferable to set the thickness (h) of the base 21, the thickness (h1) of the projection 20, the width (b1) of the projection 20, and the width (B) of the string-installing portion 10, namely, the sum of the width (b) of the base 21 and the width (b1) of the projection 20 as follows:

$3\ \text{mm} \leqq b1 \leqq 0.7B,\ 3\ \text{mm} \leqq h1 \leqq 0.75h$

Table 1 shows the dimension of each portion of the tennis racket according to the first embodiment, the second moment of area Ix indicating the index of the out-of-plane rigidity of the string-installing portion 10, the second moment of area Iy indicating the index of the in-plane rigidity of the string-installing portion 10. Reference symbol (B) shown in Table 1 indicates the whole width of the string-installing portion 10. Although not shown in Table 1, the width (b) of the base 21 is 6 mm, a thickness (m) of a wall of the string-installing portion is 1 mm, and the whole length (L) of the racket frame is 685 mm.

In the first embodiment, the thickness of the top side of the string-installing portion 10 is equal to that of the end of the throat portion 11 on the grip side thereof.

TABLE 1

| | Sectional configuration (side) [mm] | | | | ball hitting area | out-of-plane rigidity | in-plane rididity |
|---|---|---|---|---|---|---|---|
| | h | B | h1 | b1 | [in²] | Ix (mm⁴) | Iy (mm⁴) |
| E1 | 21 | 12 | 8.5 | 6 | 100 | 2300 | 1000 |
| E2 | 21 | 17 | 8.5 | 10 | 100 | 2300 | 1300 |
| C1 | 20 | 12 | . . . | . . . | 93 | 1900 | 1000 |
| C2 | 21 | 12 | . . . | . . . | 95 | 2300 | 1300 |
| C3 | 21 | 12 | . . . | . . . | 105 | 2300 | 1300 |
| C4 | 30 | 13.5 | . . . | . . . | 97 | 5400 | 1500 |
| C5 | 30 | 12.5 | . . . | . . . | 108 | 5400 | 1500 |

In the above, the sectional configuration indicate that of the string-installing portion positioned at a side of racket frame encircling the ball-hitting surface, E1 and E2 indicate tennis racket according to first embodiment and second embodiment, respectively; C1 through C5 indicate first comparison tennis racket through fifth comparison tennis racket, respectively.

Figure 2A:
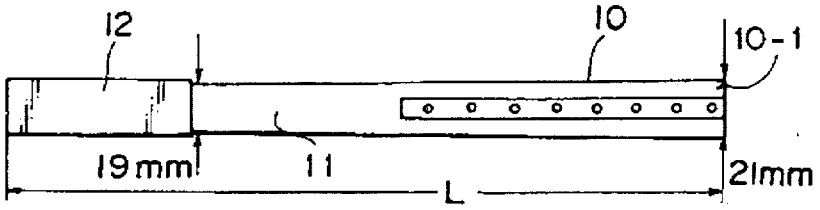
FIG. 2A is a front view showing a tennis racket according to a second embodiment of the present invention.
Figure 2B:
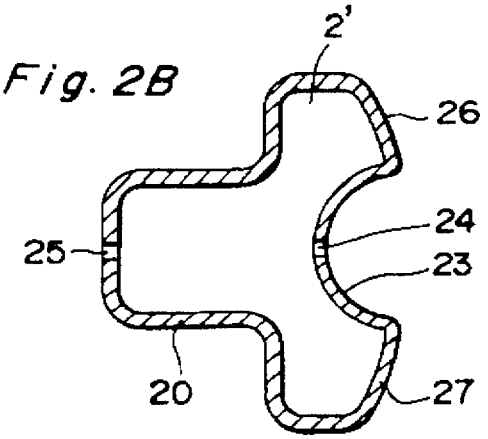
FIG. 2B is a sectional view, showing a string-installing portion, of the tennis racket according to the second embodiment of the present invention.

FIGS. 2A and 2B show a tennis racket according to a second embodiment. The string-installing portion 10 are gradually thickened from the end of the throat portion 11 on the grip side toward the top side 10-1 of the string-installing portion 10. That is, the thickness (h) of base 21 of the string-installing portion 10 is 21 mm at the top side 10-1 thereof and that of the throat portion 11 is 19 mm at the end thereof on the grip side.

In the string-installing portion 10 of T-shaped cross section, the peripheral surface 21*a* of the base 21 thereof are inclined to form tapered portions 26 and 27 on both sides of the concave 23.

Table 1 shows the dimension of each portion of the tennis racket according to the second embodiment, the second moment of area Ix indicating the index of the out-of-plane rigidity of the string-installing portion 10, the second moment of area Iy indicating the index of the in-plane rigidity of the string-installing portion 10. The thickness (m) of the wall of the string-installing portion is equal to that of the racket frame according to the first embodiment, namely, 1 mm. The whole length (L) of the racket frame also is equal to that of the racket frame according to the first embodiment.

The following operations are performed by the racket frame comprising the string-installing portion 10 of T-shaped cross section and the projection 20 projecting toward the ball-hitting surface:

Firstly, the tennis racket has a favorable repulsion performance because of the spring generated by torsion deformation of the string-installing portion 10.

Figure 3A:
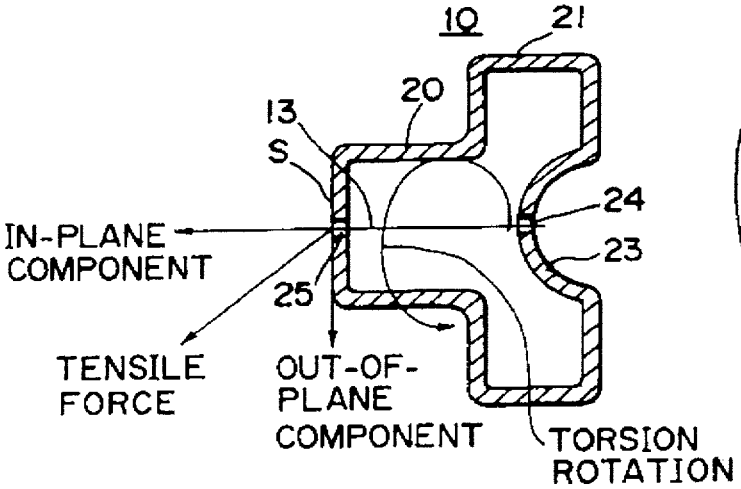
FIG. 3A is a sectional view showing the operation of the string-installing portion of the tennis racket according to the present invention.

That is, as shown in FIG. 3A, the tensile force of each string 13 is resolved into an in-plane component and an out-of-plane component due to the deformation of the string 13 caused by ball hitting, and the two components are transmitted to each gut hole 25 of the string-installing portion 10.

Figure 3B:
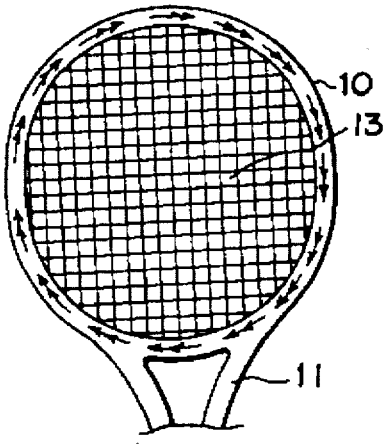
FIG. 3B is a plan view showing the operation of a principal portion of the tennis racket according to the present invention.
Figure 9:
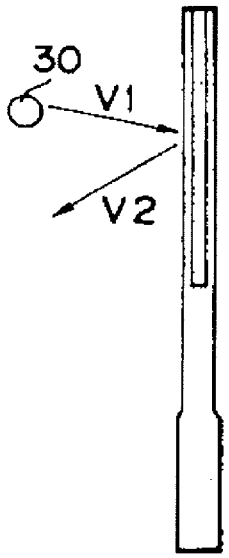
FIG. 9 is a schematic view showing a method of testing repulsion performance.

In the string-installing portion 10 of T-shaped cross section, torsion as shown by an arrow of FIG. 3 is generated due to the out-of-plane component applied to the leading end of the projection 20 positioned at the periphery of the ball-hitting surface. The spring produced by the return of the deformation (torsion) is applied to the tennis ball as a novel spring which is not generated by the conventional tennis racket. The torsion is transmitted all around the ball-hitting surface of the racket frame as shown by the double arrows of FIG. 3B. The torsion is supported by the throat portion 11 and transmitted to the grip portion 12.

The racket according to the present invention has repulsion performance superior to the conventional racket due to the novel spring action generated by the torsion.

The second operation of the racket frame according to the present invention is described below. It is difficult to make the designing of the in-plane rigidity and the out-of-plane rigidity freely, whereas according to the present invention, it is possible to do so by selecting an appropriate thickness and width of the string-installing portion 10, because the string-installing portion 10 is T-shaped in cross section.

That is, as described above, because there is a limitation in the weight of the racket frame, the peripheral length of the string-installing portion 10 in the sectional configuration thereof has a limitation in consideration of the weight of the racket frame. If the limitation of the weight is to be satisfied, there is a limitation in the peripheral length of the string-installing portion 10. If the thickness (h) of the string-installing portion 10 is set to be large, it is necessary to reduce the width (B) thereof in correspondence with the increased amount of the thickness (h).

The rigidity of the racket is expressed by the second moment of area as follows:

$$Ix=b\times h^3/12,\ Iy=b^3\times h/12$$

where Ix is a coefficient for determining the out-of-plane rigidity of the racket, and Iy is a coefficient for determining the in-plane rigidity thereof, as described previously.

Because the string-installing portion 10 is T-shaped in cross section, the value of the in-plane rigidity can be allowed to be within a required numerical range by appropriately selecting the thickness (h) of the base 21, the thickness h1 of the projection 20, the width b1 of the projection 20, and the width (B) of the string-installing portion 10. Thus, even though the ball-hitting area is set to be large, it is possible to design a high second moment of area Iy indicating the index of the in-plane rigidity, which allows even the large racket to have a high ball control performance.

Further, it is possible to enlarge the thickness (h) without increasing the second moment of area Ix indicating the out-of-plane rigidity by selecting the thickness (h) of the base 21, the thickness h1 of the projection 20, the width b1 of the projection 20, and the width (B) of the string-installing section 10.

That is, in designing the thick racket or a racket thinner than the thick racket and thicker than the mid size racket, it is possible to apply a spring generated by the spoon-shaped bending deformation to the spring generated by the conventional "thick racket" due to a decrease of the out-of-plane rigidity for the thickness (h).

As described above, according to the present invention, because the in-plane rigidity can be made to be high, even though the ball-hitting surface is set to be large, even the large racket has an improved ball control performance. Further, even a thick racket has a favorable ball control performance and gives the player a soft ball-hitting feeling by making the out-of-plane rigidity smaller for the thickness of the string-installing portion.

The third operation of the racket frame according to the present invention is a restraint of the vibration generated by strings 13.

Both vertical and horizontal strings 13 vibrate similarly to a vibration of a film after the ball collides with the strings 13 and becomes out of contact therewith. Thus, the vibration mode of the strings 13 changes rapidly from a primary mode to a high frequency mode and the vibrations of the strings 13 attenuate. The vibrations of the strings 13 are transmitted to the inner periphery of the string-installing portion 10 with the strings 13 being in contact with the peripheries of the inner gut holes 25 disposed in the inner periphery of the string-installing portion 10. Vibration waves thus generated are transmitted to the grip portion 12 via the throat portion 11.

In the conventional racket, elastic waves are generated on the inner periphery of the string-installing portion due to the vibrations of the strings transmitted from the gut holes. Then the elastic wave is transmitted to the entire frame.

On the other hand, because the string-installing portion 10 according to the present invention is T-shaped in cross section, elastic waves generated by the vibrations of the strings 13 transmitted from the gut holes 24 and 25 are curved and thus not transmitted smoothly to the entire frame. That is, the vibrations of the strings 13 are transmitted to the grip portion 12 with the vibrations being attenuated during the transmission of the elastic waves.

Further, the torsion of the racket frame generated by the out-of-plane component of the tensile force of the strings 13 has the action of restraining the resonance of the racket frame. In this manner, the restrained vibrations of the strings 13 are transmitted to the grip portion 12.

Tennis rackets shown in the comparison examples of FIGS. 4 through 8 (first through fifth comparison) were prepared as conventional tennis rackets to compare the repulsion performance and rigidity of the tennis racket according to the present invention with that of the conventional tennis rackets. The size of each portion of each tennis racket is shown in Table 1.

The entire length (L) and thickness (m) of the wall of the string-installing portion of each of the comparison tennis rackets were equal to those of the tennis rackets according to the first and second embodiments.

As apparent from the sizes shown in Table 1, the thicknesses of the first three comparison tennis rackets were equal to each other, whereas the ball-hitting areas thereof were differentiated from each other. That is, the ball-hitting area of the second comparison tennis racket was set to be greater than that of the first comparison tennis racket, and that of the third comparison tennis racket was greater than that of the second comparison tennis racket. The first and second comparison tennis rackets were mid (standard) size, whereas the third comparison tennis racket was the large racket with a standard thickness. The fourth and fifth comparison tennis rackets were thick rackets. The fifth comparison racket was not only a thick racket but also a large racket, i.e., had a large ball-hitting area.

Tests for examining the repulsion performance of the tennis rackets according to the first and second embodiments and that of the first through fifth comparison tennis rackets were conducted.

In the test, a ball 30 was thrown to each tennis racket having strings 13 installed thereon, and a ball speed V1 colliding with the ball-hitting surface and a ball speed V2 reflected thereby were measured. Further, the restitution coefficients V2/V1 were calculated.

Figure 10:
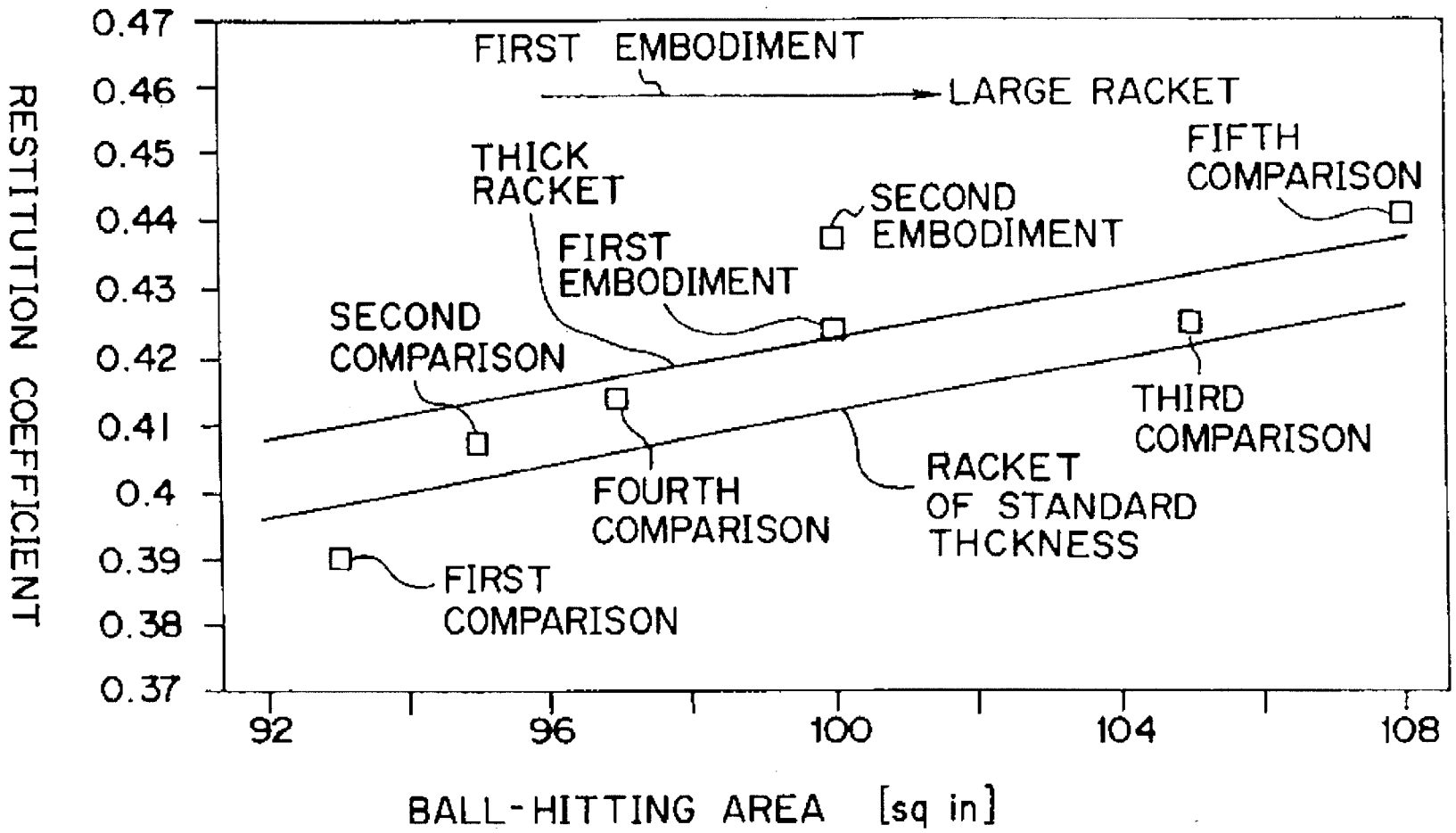
FIG. 10 is a diagram showing the relationship between restitution coefficient and a ball-hitting area.

The results are as shown in Table 1 and FIG. 10 and the following (a) through (c) were confirmed.

TABLE 2

| | Restitution coefficient | Rigidity [kg/cm] Top pressure | Side pressure | Plain pressure |
|---|---|---|---|---|
| E1 | 0.424 | 87 | 61 | 42 |
| E2 | 0.437 | 123 | 95 | 35 |
| C1 | 0.391 | 97 | 75 | 39 |
| C2 | 0.407 | 83 | 67 | 43 |
| C3 | 0.425 | 73 | 50 | 35 |
| C4 | 0.414 | 84 | 59 | 54 |
| C5 | 0.441 | 68 | 55 | 47 |

In the above, E1 and E2 indicate the tennis rackets according to the first embodiment and the second embodiment, respectively; C1 through C5 indicate a first comparison tennis racket through a fifth comparison tennis racket, respectively.

(a) In the first through third comparison tennis rackets with a standard thickness size (thickness (h)=20.21 mm), the restitution coefficient became larger with (the) an increase in the ball hitting area thereof. Therefore, the advantage of a "large racket" was confirmed.

(b) The restitution coefficients of the fourth and fifth comparison thick rackets were greater than those of the first through third comparison tennis rackets in standard thickness. That is, the advantage of a "thick racket" was confirmed. The restitution coefficient of ball-hitting area (large racket) was greater than that of the fourth comparison tennis racket. Therefore, the fifth comparison tennis racket had the advantage of the large racket as well.

(c) Although the tennis racket according to the first embodiment had a standard thickness (thickness h=21 mm, the length b1 of projection=6 mm), the spring effect of the torsion brought about by the twisted projection 20 of the string-installing portion 10 allowed the tennis racket, according to the first embodiment, to have its restitution coefficient as high as that of the thick racket.

The tennis racket according to the second embodiment (b1=10 mm) having a longer projection 20 had a restitution coefficient as high as that of the fifth comparison tennis racket having the advantage of the large racket as well as that of the thick racket.

Rigidity to top pressure, rigidity to side pressure, and rigidity to plane pressure were tested on the tennis rackets according to the first and second embodiments and the first through fifth comparison tennis rackets.

Figure 11A:
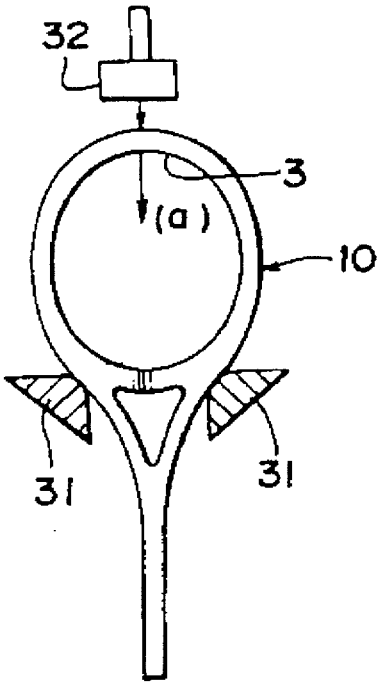
FIGS. 11A, 11B, and 11C are schematic views each showing a method of testing rigidity.

In the top pressure rigidity test, a downward load was applied to the top portion of each racket by a pressure applying tool 32, with both the lower positions of the string-installing portion 10 (namely, the position between the side portion and yoke portion) being fixed by supporting tools 31 to support each racket vertically, as shown in FIG. 11A, so as to find a spring constant (rigidity) kgf/cm for each racket based on the flexure amount of the racket frame. The top pressure rigidity is an index for comparing the in-plane rigidities of the rackets with respect to each other.

Figure 11B:
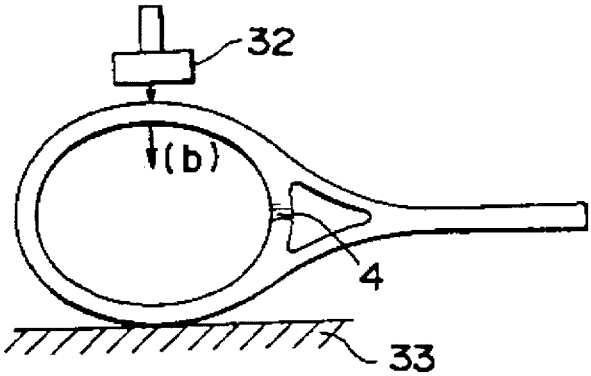

The test for examining the side pressure rigidity was conducted as follows. A load was applied to one side frame by the pressure applying tool 32, with the other side frame being supported on a fixing base 33, as shown in FIG. 11B. The side pressure rigidity is an index for comparing the in-plane rigidities of the rackets with each other.

Figure 11C:
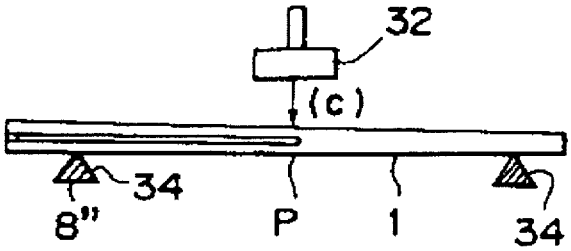

The test for examining the plane pressure rigidity was conducted as follows. A load was applied in the downward direction to the center of a racket frame horizontally placed, between the top of the racket frame and the grip end as shown in FIG. 11C, with both a point in the vicinity of the top of the racket frame and a point in the vicinity of the grip end being supported by a supporting tools 34. The plane pressure rigidity indicates an index for comparing the out-of-plane rigidities of the rackets with respect to each other.

The result of the plane pressure rigidity test is as shown in Table 2. The relationship between the ball-hitting area of each racket and the measured value of the plane pressure rigidity is as shown in FIG. 12.

Figure 12:
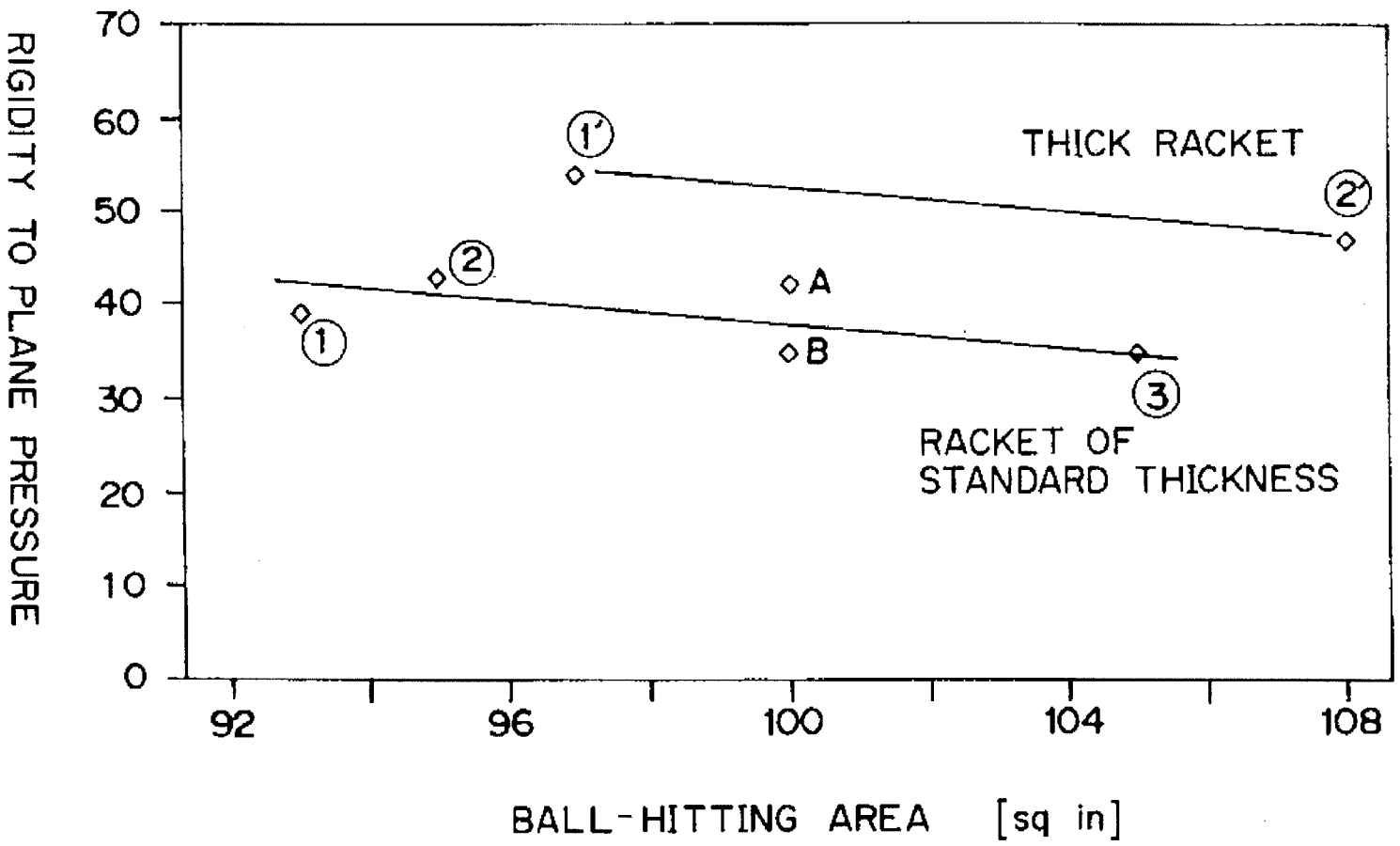
FIG. 12 is a diagram showing the relationship between rigidity to plane pressure and the ball-hitting area.

As apparent from Table 2 and FIG. 12, the thickness (h) of the string-installing portion is 21 mm in the tennis rackets according to the first and second embodiments, whereas that of the string-installing portion is 20.21 mm in the first through third comparison tennis rackets. Therefore, the plane pressure rigidities of the former are in almost the same level as those of the latter.

It was confirmed that the fourth and fifth comparison, thick rackets having a thickness (h) of 30 mm were higher in plane pressure rigidity than tennis rackets according to the first and second embodiments having a standard thickness and the first through third comparison tennis rackets having a standard thickness as well.

It was analogized that all of the first through third comparison tennis rackets having the standard thickness and the fourth and fifth comparison thick rackets became lower in plane pressure rigidity with an increase in the ball-hitting area thereof, but the level of the plane pressure rigidity of the former was not much different from that of the latter although the thickness (h) of the former and that of the latter were much different from each other. That is, the difference in the plane pressure rigidity was not much for the difference in the thickness (h).

It can be said from the above description that the tennis rackets according to the first and second embodiments, having a standard thickness, give a soft ball-hitting feeling to the player because the racket frames are flexible, which makes the time period of the contact between the ball and the strings long. Accordingly, the tennis rackets having a standard thickness according to the first and second embodiments is capable of controlling the ball more easily than the thick racket.

The results of the measurements of the top pressure rigidities are shown in Table 2. The relationship between the top pressure rigidities and the ball-hitting area is shown in FIG. 13.

Figure 13:
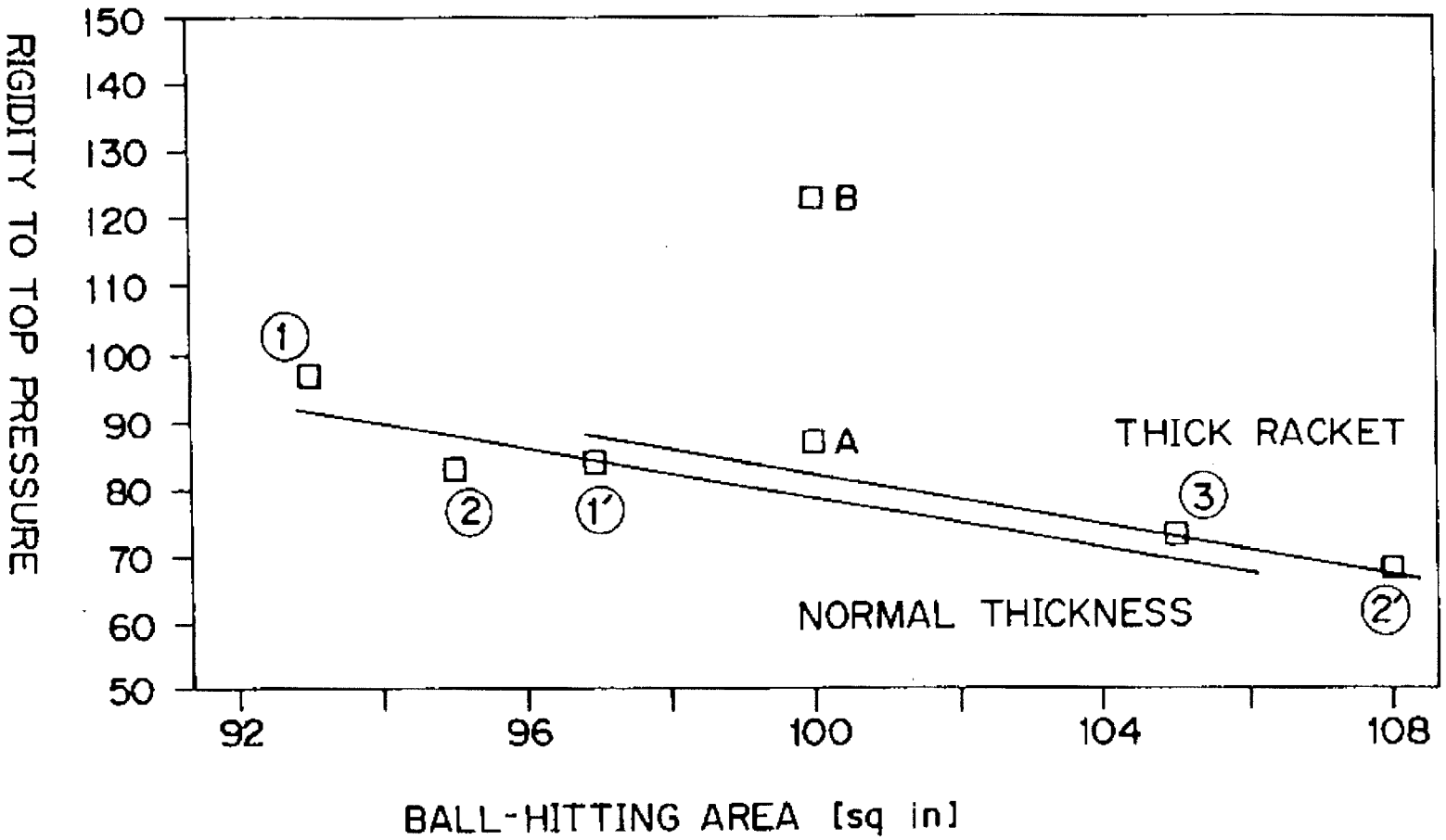
FIG. 13 is a diagram showing the relationship between rigidity to top pressure and the ball-hitting area.

As shown in Table 2 and FIG. 13, in the first through fifth comparison tennis rackets, the top pressure rigidity dropped with an increase in the ball-hitting area, irrespective of the thickness (h) thereof. This means that with an increase in the ball-hitting area, the in-plane rigidity of each tennis racket decreases and thus the racket frame is deformed in a large degree and thus the ball control performance thereof becomes unfavorable when the ball is hit thereby.

Each of the tennis rackets according to the first and second embodiments had a top pressure rigidity much higher than that of conventional tennis rackets in which the string-installing portion is not T-shaped in cross section and the ball-hitting area (100 square inches) is equal to that of each of the rackets according to the first and second embodiments. That is, the in-plane rigidity of each of the tennis rackets according to the first and second embodiments is higher than that of conventional tennis rackets, indicated as the first through fifth comparison tennis rackets. The result is due to the reasons given as to why the string-installing portion is T-shaped in cross section and the state in which the projection 20 mounted on the inner surface of the base 21 serves as a generated hoop. In this manner, the effect of the hoop for suppressing the occurrence of in-plane deformation is generated to improve the stability of the ball-hitting surface.

The results of the measurements of the side pressure rigidities are shown in Table 2. The relationship between the side pressure rigidities and the ball-hitting area is shown in FIG. 14.

Figure 14:
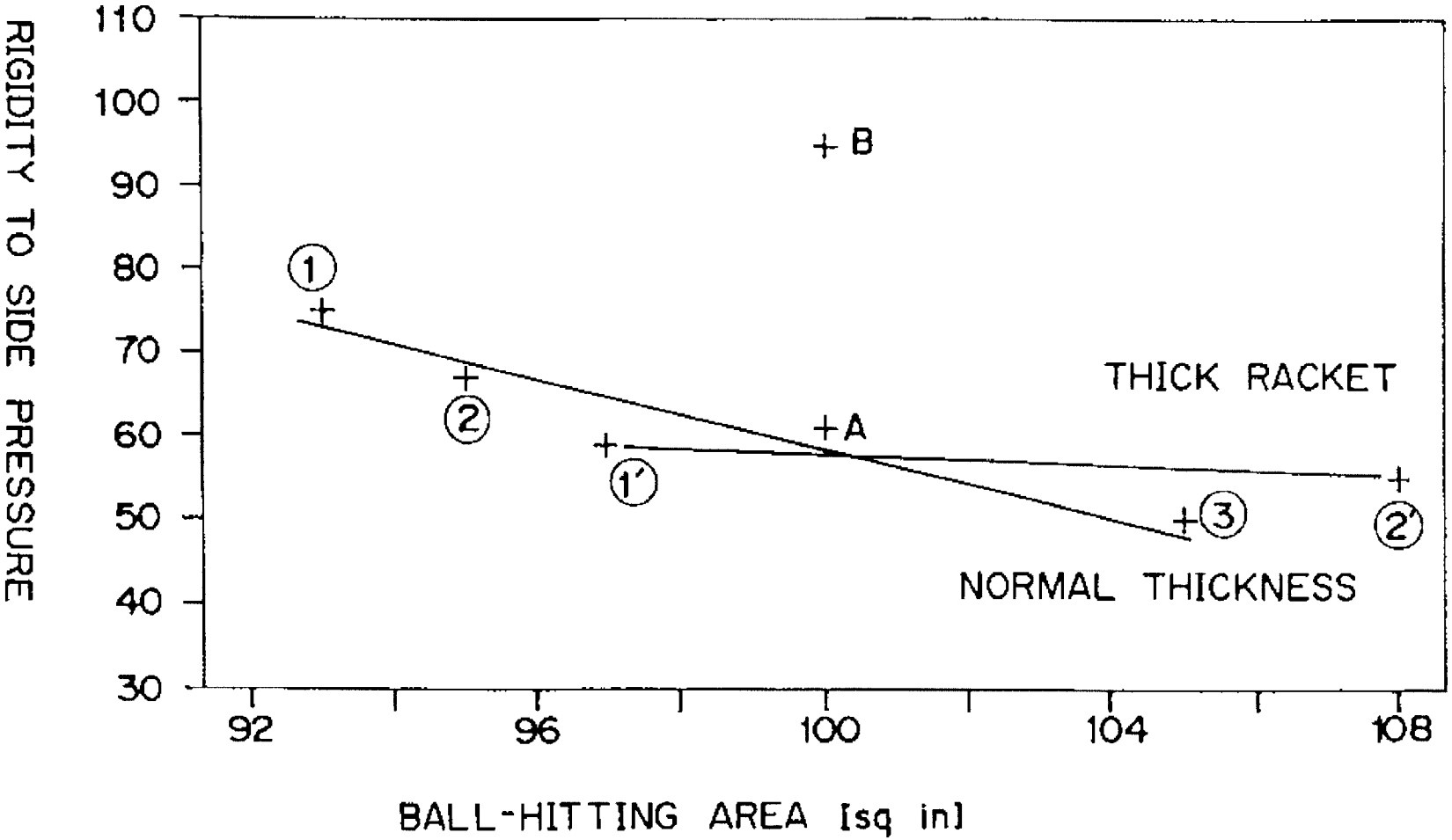
FIG. 14 is a diagram showing the relationship between rigidity to side pressure and the ball-hitting area.
Figure 15A:
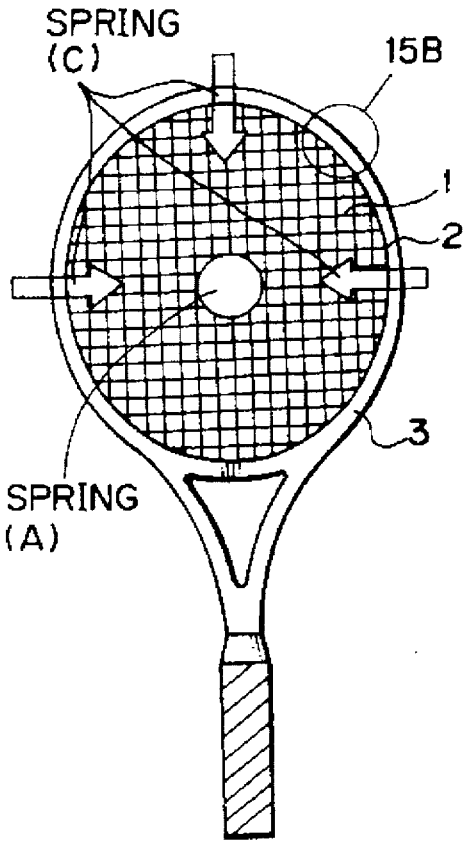
FIG. 15A, 15B, and 15C are schematic views each showing the spring effect generated on a tennis racket.
Figure 15B:
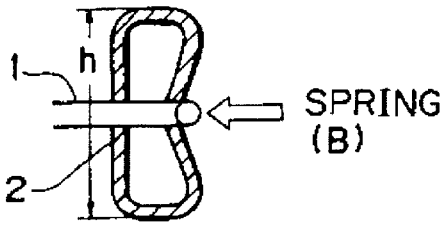
Figure 15C:
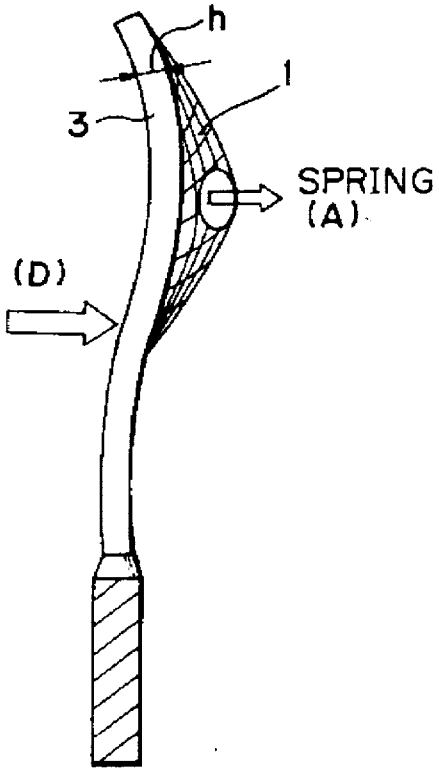
Figure 17:
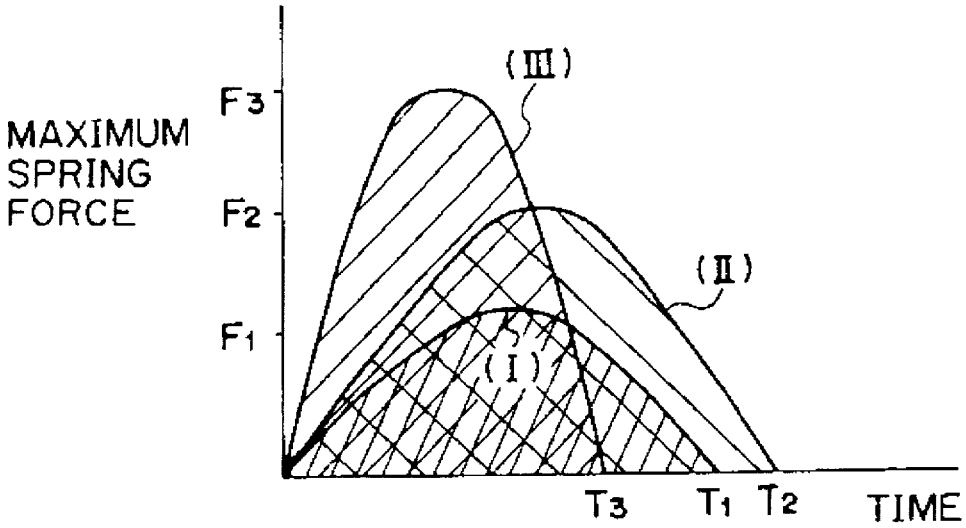
FIG. 17 is a diagram for comparing the repulsion performance of a mid (standard) size racket, a large racket, and a thick racket with each other.
Figure 19:
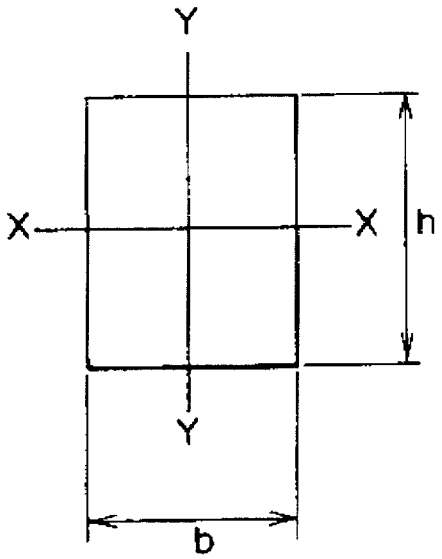
FIG. 19 is a schematic view showing a sectional rigidity of a rectangle.
Figure 18:
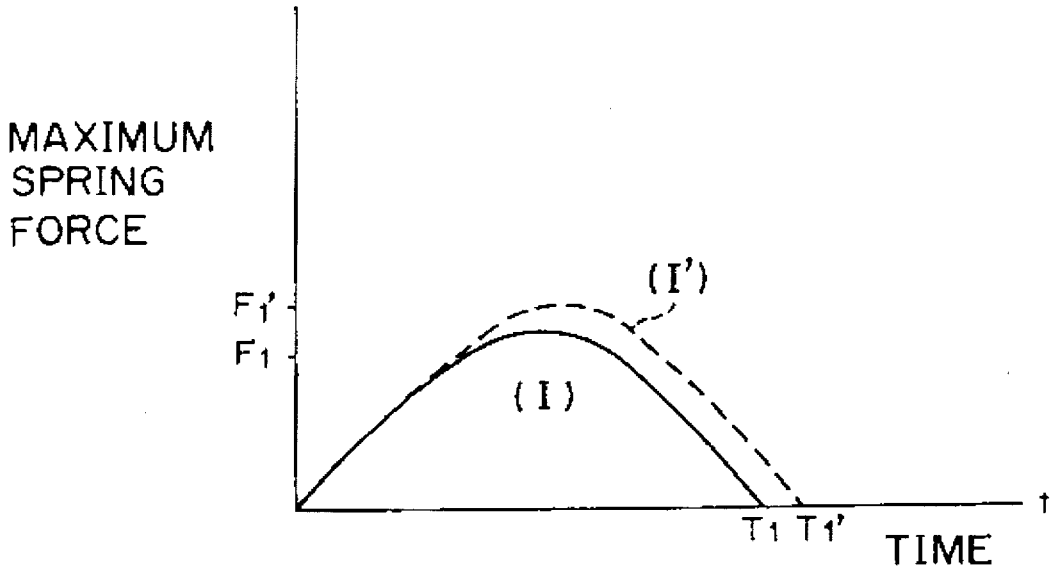
FIG. 18 is a diagram for comparing the repulsion performance of a racket according to the present invention and a conventional mid (standard) size racket with each other.

As shown in Table 2 and FIG. 14, the tennis rackets according to the first and second embodiments were higher than the first through fifth comparison tennis rackets in the side pressure rigidity thereof.

The test results indicate that the tennis rackets according to the first and second embodiments can be made to be higher than the first through fifth comparison tennis rackets in the in-plane rigidity thereof and that the in-plane rigidity can be freely set by altering the length of the projection 20 of the string-installing portion 10.

Further, the test results also indicate that in the racket according to the present invention, even though the ball-hitting area is set to be great to provide the advantage of the large racket, the ball control performance can be improved by setting the in-plane rigidity to be high.

From the above-described test results of repulsion performance and rigidity, the following points were confirmed.

The T-shaped string-installing portion allows the repulsion performance of the racket to be improved due to the spring effect of the torsion which brought about the twisted projection 20.

The construction of the racket according to the present invention which comprises the T-shaped string-installing portion, overcomes the disadvantage of a conventional large racket having a large ball-hitting area or a conventional thick racket having a thick string-installing portion. That is, a "large racket" according to the present invention comprising a T-shaped string-installing portion and a large ball-hitting surface or a "thick racket" according to the present invention, comprises a thick string-installing portion have a favorable ball control performance and gives a soft ball-hitting feeling to the player similarly to the mid size racket in addition to a favorable repulsion performance which is a feature of the large or thick racket. That is, the present invention provides a large racket or a thick racket superior in ball-hitting feeling and ball control performance, and repulsion performance.

In order to check the test result, tennis balls were hit by the tennis rackets according to the first and second embodiments and the first through fifth comparison tennis rackets.

Ten persons hit tennis balls by the tennis rackets according to the first and second embodiments and the first through fifth comparison tennis rackets in order to test the performance thereof.

The test results are as follows:

Regarding the repulsion performance, eight persons out of 10 responded that "The repulsion performances of the rackets according to the first and second embodiments were equivalent to that of the large third comparison racket and that of thick fifth comparison racket. The repulsion performance of the racket according to the second embodiment was superior to that of the racket according to the first embodiment."

Regarding the ball control performance, seven persons out of 10 responded that "The ball control performances of the rackets according to the first and second embodiments were equivalent to those of the first and second comparison rackets. The ball control performances of the third and fifth comparison rackets were less favorable than those of the rackets according to the first and second embodiments and the first and second comparison rackets. The ball control performances of the rackets according to the first and second embodiments were not different from each other".

Regarding ball-hitting feeling, 10 persons responded that "The feeling given by the rackets according to the first and second embodiments was equivalent to that given by the first, second, and third comparison rackets and softer than that given by the fourth and fifty comparison rackets".

Regarding string vibration-restraining effect of the string-installing portion, six persons responded that "The string-installing portion was effective for restraining the vibration of strings." Four persons responded that "The string-installing portion was ineffective for restraining the vibration of strings."

As apparent from the foregoing description, according to the tennis racket of the present invention, the string-installing section having a T-shaped cross section allows a novel spring of torsion deformation to be generated when a tennis ball is hit, and the novel spring improves the repulsion performance of the tennis racket.

Accordingly, the repulsion performance of a mid (standard) size racket is as high as that of a large or thick racket although the ball-hitting area of the mid size racket is not as great as the large racket and the thickness thereof is not as great as that of the thick racket.

Because the string-installing portion is T-shaped in cross section, the in-plane rigidity can be freely designed and thus a high in-plane rigidity can be maintained even though the ball-hitting area is set to be large. The "Hoop effect" can be generated unlike the conventional racket, thus dramatically improving the in-plane stability. Therefore, the large racket, having a great ball-hitting area, developed to increase repulsion performance, is allowed to have a favorable ball control performance.

Further, the vibration of the strings can be restrained in hitting a ball and thus a player has a favorable ball-hitting feeling.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A tennis racket frame comprising a ball hitting surface, a string-installing portion formed along an entire periphery of the ball-hitting surface thereof, a throat portion and a grip portion, wherein said string-installing portion has a T-shaped configuration in cross section in which the base of the T defines a projection which extends toward the ball-hitting surface in which strings are installed and the top of the T defines a base which is perpendicular to the projection.

said projection and said base being formed symmetrically with respect to a center line passing through a center of the projection wherein the relationship between a width (b1) of the projection and a width (B) of the string installing portion is defined by the following formula (A) and the relationship between a thickness (h1) of the projection and thickness (h) of the base is defined by the following formula (B):

(A) $3\ \text{mm} \leqq b1 \leqq 0.8B$ (B) 3 mm≦h1≦0.75h, said string-installing portion having a plurality of gut holes formed therein which pass through the center of said projection and through the center of the base.

2. The tennis racket frame as defined in claim 1, wherein said string-installing portion is hollow and has a concave portion formed on an outer surface of said base, said concave portion being provided with a grommet.

3. The tennis racket frame as defined in claim 1, wherein the gut holes are formed at regular intervals and through a center line passing through the center of the projection.

* * * * *